United States Patent [19]

Wu

[11] Patent Number: 5,004,137

[45] Date of Patent: Apr. 2, 1991

[54] STRUCTURE OF GOLF SCORE BOARD

[76] Inventor: Jiin-Tang Wu, No. 35-1, Jih Hsin Street, Tu Cheng Hsiang, Taipei Hsien, Taiwan

[21] Appl. No.: 464,065

[22] Filed: Jan. 12, 1990

[51] Int. Cl.[5] ..... B60R 9/00; B65D 85/00

[52] U.S. Cl. ..... 224/274; 224/919; 206/315.9

[58] Field of Search ..... 273/32 D, 32 E; 224/274, 919, 918; 206/315.3, 315.5, 315.9

[56] References Cited

U.S. PATENT DOCUMENTS 2,665,830 1/1954 Fowler ..... 224/918

3,873,009 3/1975 Goudreau ..... 273/32 D

*Primary Examiner*—Henry J. Recla

*Assistant Examiner*—David J. Walczak

*Attorney, Agent, or Firm*—Varndell Legal Group

[57] ABSTRACT

A structure of a golf score board for golf cart, which is unitarily made of resilient material through shape molding process and comprises two raised side wall portions having two hook-like projecting ends, two openings, two slant faces and a division wall portion which define two receiving spaces for holding two golf balls.

1 Claim, 3 Drawing Sheets

STRUCTURE OF GOLF SCORE BOARD

BACKGROUND AND SUMMARY OF THE INVENTION

The present invention is related to a golf score board and more particularly to the one which is unitarily incorporated with a retaining structure convenient for temporarily holding golf balls.

Referring to FIG. 1, a golf cart is generally equipped with a score board 1 for the counting of the number of strokes a player did. The conventional golf score board for a golf cart is generally incorporated with a golf ball holder. As illustrated in FIG. 2, a golf ball holder 2 is unitarily made on a score board 1 through shape molding process and divided by two division boards 5 and 5' into two receiving chambers for the setting therein of two golf balls. A foam plastic strip 4 is partly mounted on the golf ball holder 2 and fixedly secured to the score board 1 by means of two rivets 3 and 3'. The golf ball holder is specially designed in such a size that a golf ball can be firmly retained in the golf ball holder, by means of the elastic property of the foam plastic strip 4, as soon as it is placed therein. Because of big contact area between a golf ball and the golf ball holder 2, the friction area therebetween is relatively big. Therefore, one shall have to use both hands to pick up a golf ball from the golf ball holder 2. Because there is tolerance in diameter between golf balls, when a golf ball of relatively bigger diameter is placed on the golf ball holder 2 of the score board 1 of a golf cart, it will be particularly difficult to pick it up. Because the connecting portions between the score board 1 and the golf ball holder 2 are limited to four lines (two between the score board and the two division boards, and two between the score board the two lateral side wall of the golf ball holder), strong torque force which is applied to the golf ball holder 2 against the score board 1 may easily damage the whole structure to cause the score board 1 to break along the dotted line as indicated in FIG. 2. Further, because of the use of foam plastic strip and rivets, the conventional golf ball holder incorporated golf score board for golf cart is inevitably more complicated to manufacture.

An object of the present invention is to provide a golf score board incorporating with an unitary golf ball holder portion, which can be unitarily made through shape molding process to reduce its manufacturing cost and simplify its production process.

Another object of the present invention is to provide a golf score board incorporating with an unitary golf ball holder portion which is durable in use.

Still another object of the present invention is to provide a golf score board incorporating with an unitary golf ball holder in which a golf ball can be conveniently placed and firmly retained therein or picked up therefrom by means of the operation through a single hand.

DETAILED DESCRIPTION OF THE PREFERRED EMBODIMENT

Figure 1:
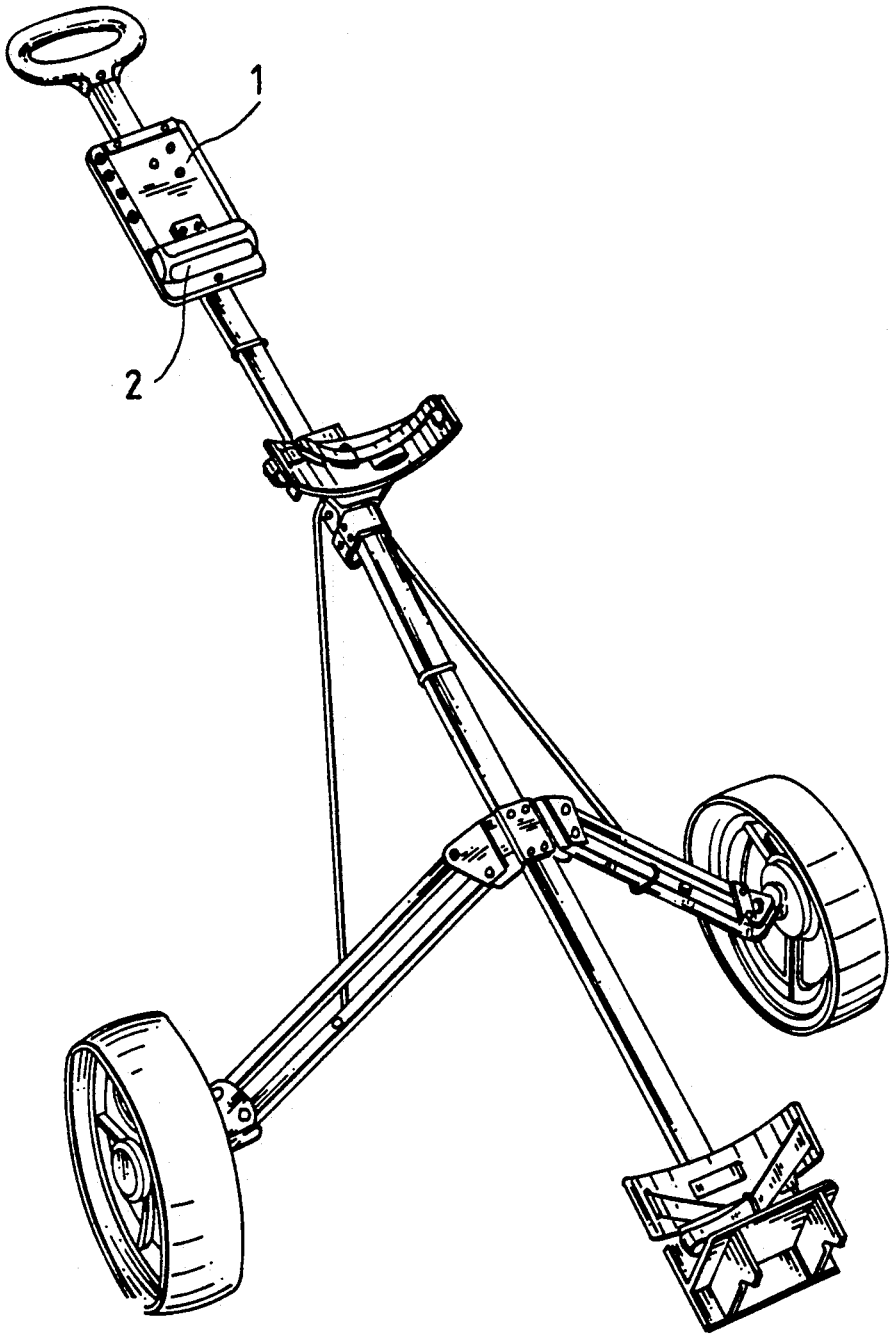
Fig.1 PRIOR ART
FIG. 1 illustrates a conventional golf cart which is equipped with a golf score board which comprises a golf ball holder.
Figure 2:
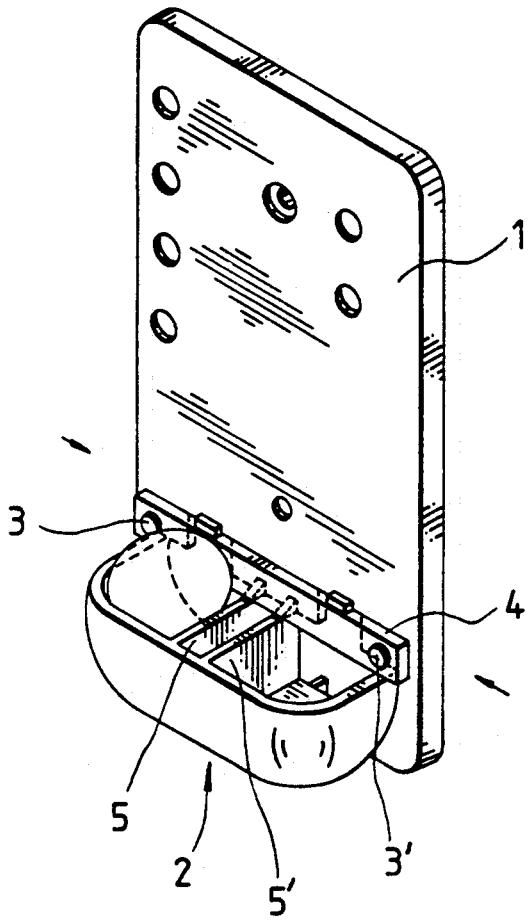
Fig. 2 PRIOR ART
FIG. 2 illustrates a golf score board incorporated with a golf ball holder in accordance with the prior art.
Figure 3:
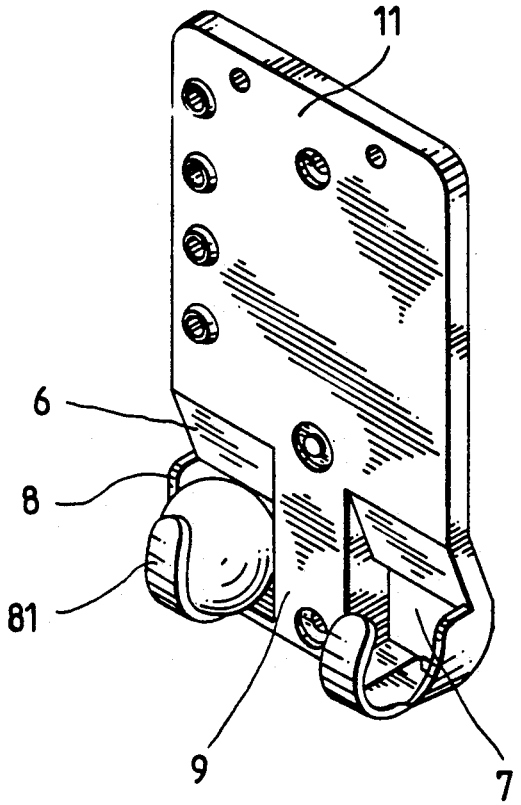
FIG. 3 is a perspective view of the present invention.

Referring to FIG. 3, therein illustrated is a golf score board 11 embodying the present invention which is unitarily made of resilient material through shape molding process and comprises two openings 7 at its lower end respectively in a size smaller than the diameter of a golf ball. Two slant faces 6 are made on the golf score board 11 at one side of the openings 7. Two side wall portions 8 are raising from the golf score board 11 at the outer sides of the two openings 7. A unitary hook-like projecting end 81 each respectively extends upwardly and inwardly from the upstanding side wall portions 8. A division wall portion 9 is disposed between the two openings 7. Thus, the two slant faces 6, the two openings 7, the two side wall portions 8 and the division wall portion 9 define two receiving spaces for holding two golf balls. When golf balls are inserted to the two receiving spaces, they can be firmly retained by the two hook-like projecting ends 81. During the picking of a golf ball from a receiving space, the golf ball is only partly in contact with one of the slant faces 6 and one of the hook-like projecting ends 81, therefore, the golf ball can be convenient removed therefrom with one single hand.

What is claimed is:

1. A golf score board comprised of:

a planar member made of resilient material and having an end portion;

two openings located at said lower portion; each of said openings being bound by side walls defining a top edge, a bottom edge, an inner side edge and an outer side edge, said openings are sized so as not to allow a golf ball to pass therethrough;

said planar member including a dividing wall portion located between said openings;

a slanted face located adjacent each of said top edges of said openings, said faces extending from said planar member and slanting rearwardly and downwardly from said planar member to said top edges;

said side walls of said outer and bottom side edges of said openings extending orthogonally with respect to said planar member;

said side walls of said inner side edges of said openings extending from said planar member to said inner side edges;

a hook-like projection extending from each of said side walls of said bottom edges and outwardly of said planar member and overlying said openings so as to curve toward said openings; whereby a golf ball can be resiliently held between said slanted faces, said side walls and said hook-like projections and be easily removed therefrom.

* * * * *